US005608511A

United States Patent [19]

Attridge

[11] Patent Number: 5,608,511

[45] Date of Patent: Mar. 4, 1997

[54] VACUUM TRANSPORT APPARATUS

[75] Inventor: David M. Attridge, Rochester, N.Y.

[73] Assignee: Xerox Corporation, Stamford, Conn.

[21] Appl. No.: 583,906

[22] Filed: Jan. 11, 1996

[51] Int. Cl.[6] ..... G03G 21/00

[52] U.S. Cl. ..... 399/398; 271/197

[58] Field of Search ..... 355/312, 309; 271/196, 197, 198; 198/689.1

[56] References Cited

U.S. PATENT DOCUMENTS

| | | | |
|---|---|---|---|
| 4,017,065 | 4/1977 | Poehlein | 271/80 |
| 4,058,306 | 11/1977 | Fletcher | 271/80 |
| 4,494,166 | 1/1985 | Billings et al. | 361/214 |
| 4,992,835 | 2/1991 | Matsuzaka | 355/312 |
| 5,031,002 | 7/1991 | Yaguchi | 355/312 |
| 5,063,415 | 11/1991 | Ariyama | 355/312 |

*Primary Examiner*—Arthur T. Grimley
*Assistant Examiner*—Quana Grainger
*Attorney, Agent, or Firm*—William A. Henry, II

[57] ABSTRACT

A prefuser vacuum transport apparatus that increases the latitude of sheet acquisition includes at least one perforated belt entrained around a vacuum plenum to provide a limited drive force on sheets being driven by the vacuum transport apparatus. The vacuum plenum includes a vacuum port surface having a profile that is contoured to follow the profile of the stiffest sheet to be transported with the maximum specified curl. The belt follows the port surface contour.

3 Claims, 3 Drawing Sheets

VACUUM TRANSPORT APPARATUS

BACKGROUND OF THE INVENTION

This invention relates to copy sheet transport systems, and more particularly, to an improved prefuser vacuum transport for copy sheets transported in a copier/printer.

In copier/printer machines, it is common to transport sheets from the photoreceptor to the fuser by means of a multi-belt vacuum transport. Substantial vacuum pressure is usually desirable to provide adequate control over each sheet. This is especially true in machines where the unfused toner image is on the underside of the sheet and the sheet must be suspended from the underside of the vacuum transport. Other factors such as paper curl, cockle and high stiffness also increase pressure requirements.

When a sheet is exiting a photoreceptor horizontally the lead edge portion of the sheet is cantilevered until it is acquired by the vacuum transport. In applications where the vacuum transport is above the sheet, the effects of gravity add to the problem of acquisition due to sheet droop. This droop, in addition to sheet curl and sheet bending stiffness result in sensitive positioning of the vacuum transport with respect to the photoreceptor, especially when the copier/printer is to handle 110 pound index paper. Thus, it would be an advantage to solve the problem of getting the vacuum source closer to the sheet in order to effectively transport heavy weights of paper.

PRIOR ART

A typical copy sheet vacuum transport assembly that is used to transport copy sheets between a photoreceptor and a fuser of an electrophotographic apparatus is disclosed in U.S. Pat. No. 4,494,166 and includes a plurality of belts entrained around a flat vacuum plenum which pull each sheet being transported against the plurality of belts and propels each sheet until the hold of the vacuum from the plenum is no longer effective.

In U.S. Pat. No. 4,017,065 a transfer-fusing speed compensation apparatus is shown where the fuser rolls are positioned closer than the dimensions of the copy sheet from-the image transfer area. Speed mismatch compensation between the fuser roll nip and the initial image support surface is provided by intentionally driving the fuser roll nip at a different velocity to form a buckle in the intermediate portion of the copy sheet controller by selective cyclic reductions in the vacuum applied to a configured manifold guide surface. The guide surface may be divided into segments, through one of which the vacuum is continuously maintained.

A detack and stripping system is disclosed in U.S. Pat. No. 4,058,306 that includes a vacuum plenum that supports a sheet after it is detacked from a photoreceptor.

SUMMARY OF THE INVENTION

Accordingly, a prefuser vacuum transport apparatus that increases the latitude of sheet acquisition is disclosed which includes at least one perforated belt entrained around a vacuum plenum to provide a limited drive force on sheets being driven by the vacuum transport apparatus. The vacuum plenum includes a vacuum port surface having a profile that is contoured to follow the profile of the stiffest sheet with the maximum specified curl. The belt follows the port surface contour.

DESCRIPTION OF THE DRAWINGS

All of the above-mentioned features and other advantages will be apparent from the example of one specific apparatus and its operation described hereinbelow. The invention will be better understood by reference to the following description of this one specific embodiment thereof, which includes the following drawing figures (approximately to scale) wherein.

DETAILED DESCRIPTION OF THE PREFERRED EMBODIMENT

The invention will now be described by reference to a preferred embodiment of the prefuser vacuum transport system of the present invention preferably for use in a conventional copier/printer. However, it should be understood that the sheet vacuum transport method and apparatus of the present invention could be used with any machine environment in which transport of sheets is desired.

Figure 1:
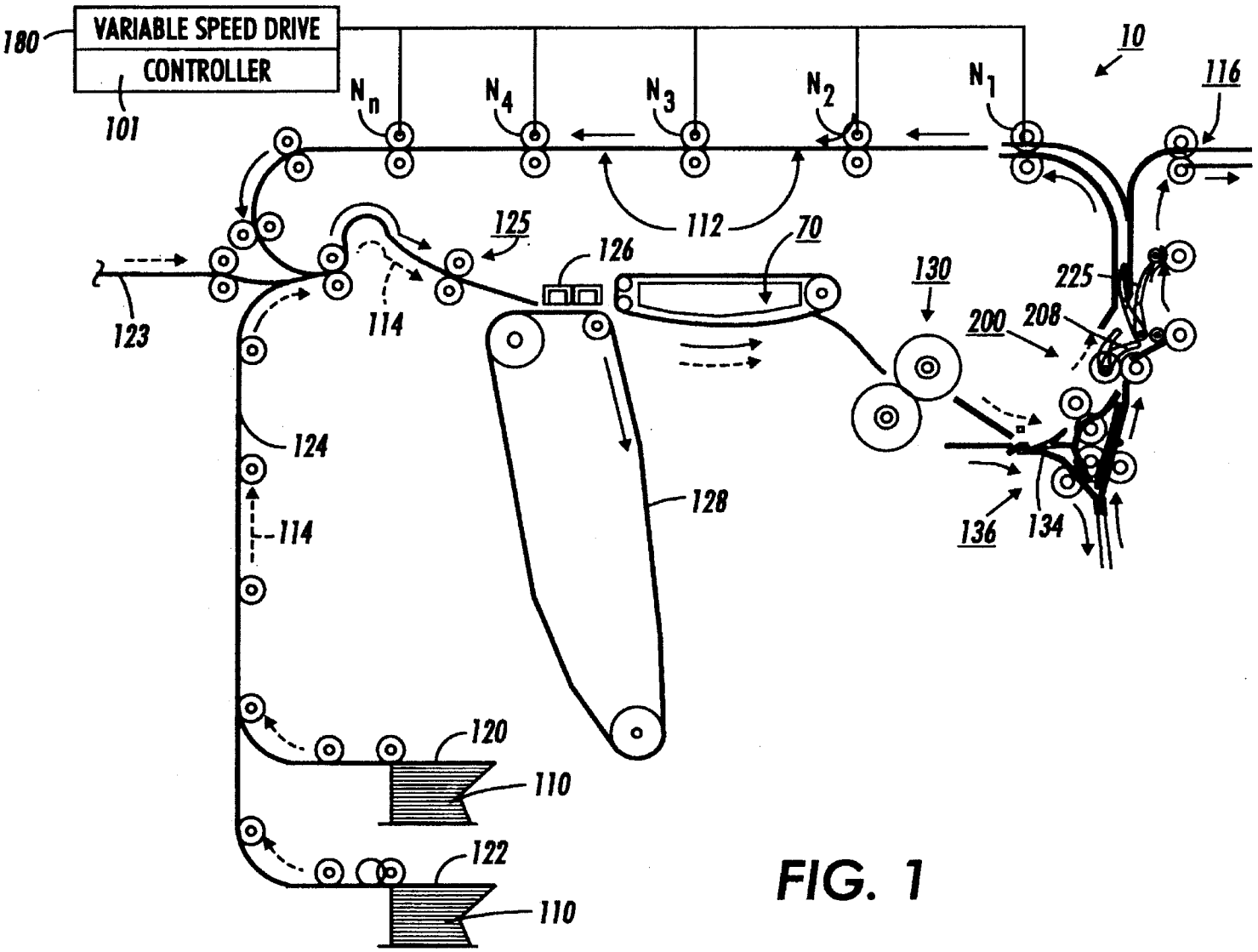
FIG. 1 is an side view of an illustrative printing machine incorporating the prefuser vacuum transport apparatus of the present invention.

For a general understanding of the features of the present invention, reference is made to the drawings. In the drawings like reference numerals have been used throughout to designate identical elements. FIG. 1 schematically depicts the various components of an illustrative electrophotographic printing machine incorporating the prefuser vacuum transport apparatus of the present invention therein.

Describing first in further detail the exemplary printer embodiment with reference to FIG. 1, there is shown a duplex laser printer 10 by way of example of automatic electrostatographic reproducing machines of a type like that of the existing commercial Xerox Corporation "DocuTech" printer shown and described in U.S. Patent No. 5,095,342 suitable to utilize the vacuum transport system of the present invention. Although the disclosed method and apparatus is particularly well adapted for use in such digital printers, it will be evident from the following description that it is not limited in application to any particular printer embodiment. While the machine 10 exemplified here is a xerographic laser printer, a wide variety of other printing systems with other types of reproducing machines may utilize the disclosed prefuser vacuum transport system.

Turning now more specifically to this FIG. I system 10, the photoreceptor is 128, the clean sheets 110 are in paper trays 120 and 122 (with an optional high capacity input path 123), the vertical sheet input transport is 124, transfer is at 126, fusing at 130, inverting at 136 selected by gate 134, decurling at 200 with the use of gates 208 and 225, etc. There is an overhead duplex loop path 112 with plural variable speed feed rollers N1-Nn providing the majority of the duplex path 112 length and providing the duplex path sheet feeding nips; all driven by a variable speed drive 180 controlled by the controller 101. This is a top transfer (face down) system. Gate 208 selects between output 116 and dedicated duplex return loop 112 here.

In this FIG. 1 embodiment, the endless loop duplex (second side) paper path 112 through which a sheet travels during duplex imaging is illustrated by the arrowed solid lines, whereas the simplex path 114 through which a sheet to be simplexed is imaged is illustrated by the arrowed broken lines. Note, however, that the output path 116 and certain other parts of the duplex path 112 are shared by both duplex sheets and simplex sheets, as will be described. These paths are also shown with dashed-line arrows, as are the common input or "clean" sheet paths from the paper trays 120 or 122.

After a "clean" sheet is supplied from one of the regular paper feed trays 120 or 122 in FIG. 1, the sheet is conveyed by vertical transport 124 and registration transport 125 past image transfer station 126 to receive an image from photoreceptor 128. The sheet then passes through fuser 130 where the image is permanently fixed or fused to the sheet. After passing through the fuser, a gate 134 either allows the sheet to move directly via output 116 to a finisher or stacker, or deflects the sheet into the duplex path 112, specifically, first into single sheet inverter 136 here. That is, if the sheet is either a simplex sheet, or a completed duplex sheet having both side one and side two images formed thereon, the sheet will be conveyed via gate 134 directly to output 116. However, if the sheet is being duplexed and is then only printed with a side one image, the gate 134 will be positioned by a sensor (not shown) and controller 101 to deflect that sheet into the inverter 136 of the duplex loop path 112, where that sheet will be inverted and then fed to sheet transports 124 and 125 for recirculation back through transfer station 126 and fuser 130 for receiving and permanently fixing the side two image to the backside of that duplex sheet, before it exits via exit path 116. All of the sheets pass through decurler 200.

Figure 2:
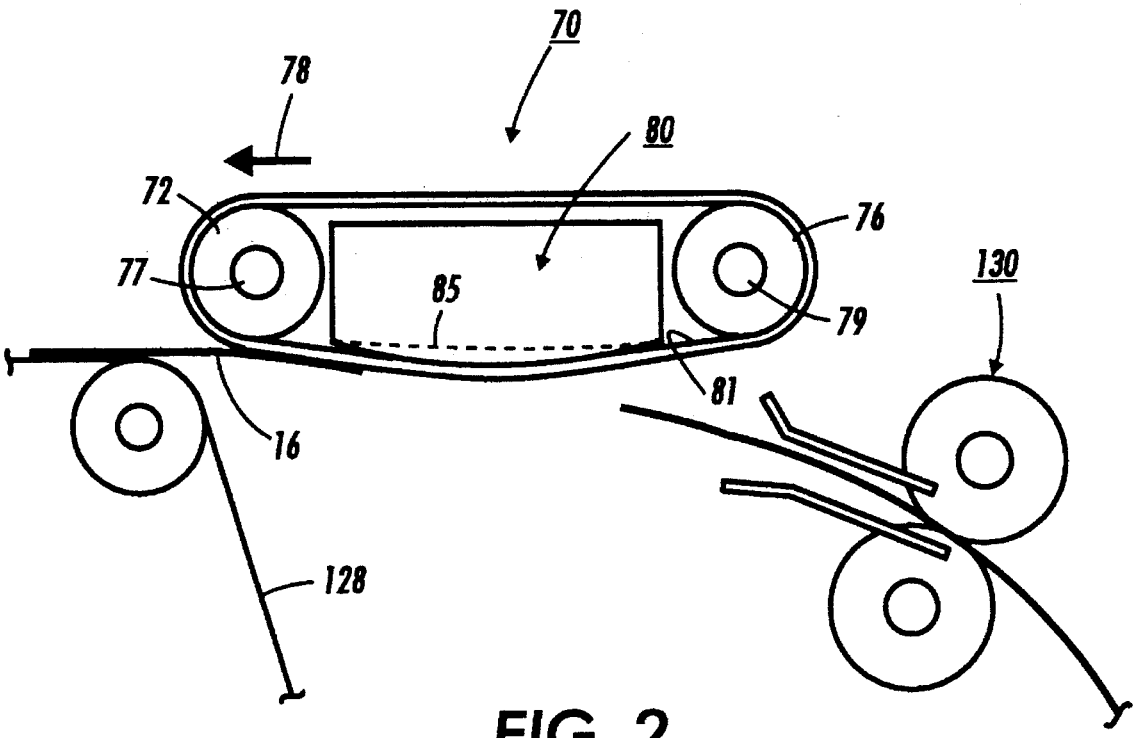
FIG. 2 is a side view of the prefuser vacuum transport apparatus shown in FIG. 1 with the profile of a prior art vacuum transport port surface shown in phantom.

In accordance with the present invention, as more specifically shown in FIG. 2, a prefuser transport 70 is disclosed as comprising at least one perforated belt 71 that is entrained around drive roll 72 and idler roll 76, mounted on rotatable shafts 77 and 79, respectively. Multiple perforated belts could be used, if desired. Drive roll 72 and idler roll 76 are mounted for rotation by shaft 77 in the direction of arrow 78 in order to drive sheets in the direction of fuser 130. Vacuum plenum 80 is situated between drive roll 72, idler roll 76 and perforated belt 71 to apply vacuum pressure to the non-imaged side of copy sheets that have received images at transfer station 126. The vacuum plenum attaches individual copy sheets to the outer surface of belt 71 and they are transported to fuser 130 where the unfused image on the sheets is fused to the copy sheets.

To answer the need to increase the latitude of prefuser transport 70 in order that sheets of 110 pound index paper with 255 mm or smaller radius down curl can be captured by the vacuum belt 71 with ease, vacuum plenum 80 in FIG. 2 is configured with a convex profile in its bottom surface 81 that is contoured or angled to follow the profile of the stiffest sheet and maximum curl that is to be fed. As indicated in phantom at 85, the flat profile of existing prefuser vacuum transport plenum 80 allows the tensioned belt to sag prior to acquisition of a sheet regardless of belt tension . . . In contrast, the contoured configuration of the vacuum plenum of the present invention keeps the belt close to the port surface of the plenum, thus the sheet does not have to additionally "lift" the belt during sheet acquisition.

Figure 3:
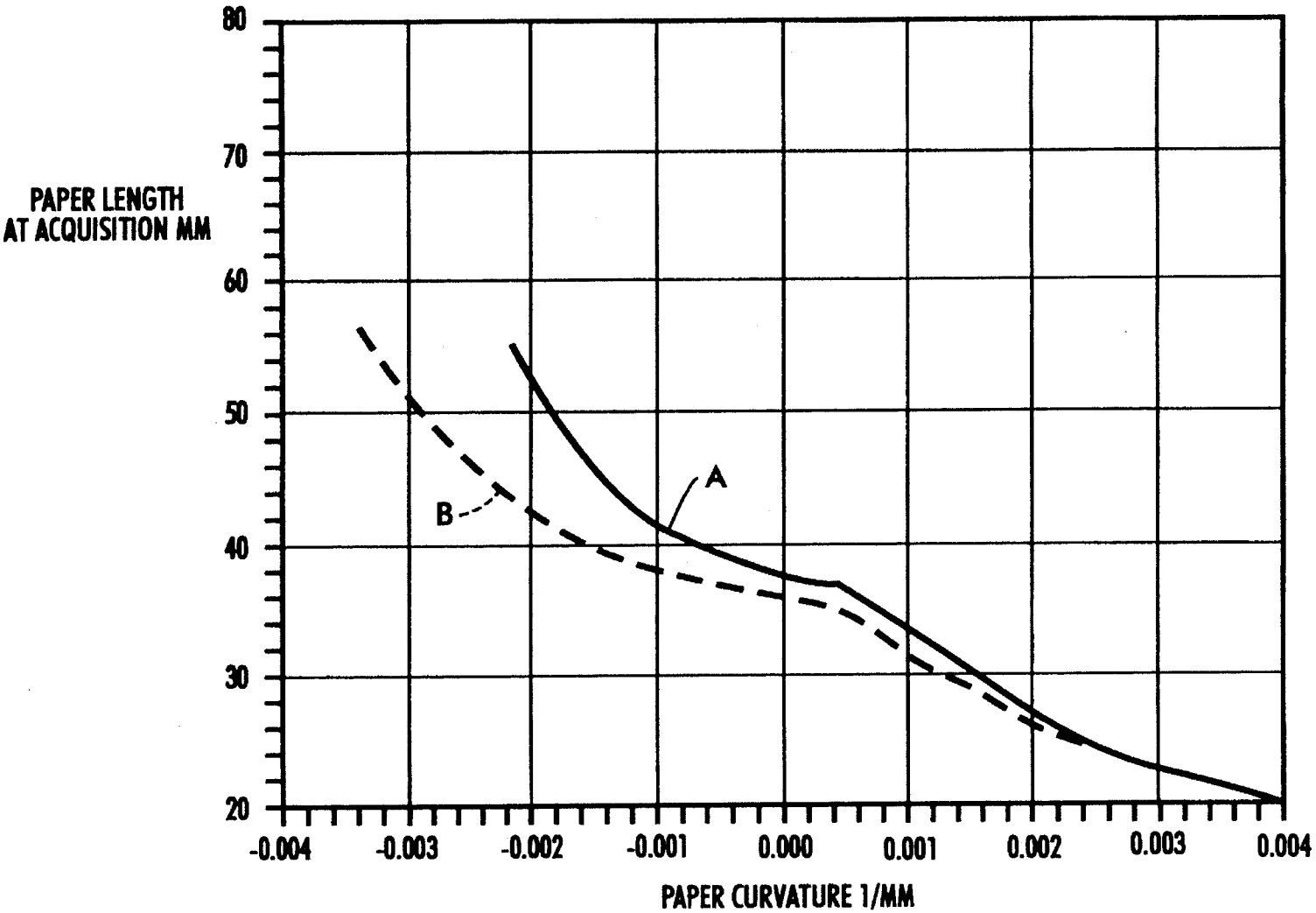
FIG. 3 is a plot of analytical results showing a significant advantage in the ability to acquire 110 pound paper over a full range of curls.

A plot in FIG. 3 of analytical results shows a significant advantage in the ability of the prefuser transport 70 of the present invention to acquire 110 pound paper over a full range of curls. In the plot, effects of paper curvature on acquisition length and belt profile modification is shown where solid line A represents test results obtained using a flat, horizontal vacuum plenum port surface while the dotted line B represents test results obtained with the curved plenum port surface profile in accordance with the present invention as shown in FIGS. 1 and 2.

It should now be apparent that a prefuser vacuum transport has been disclosed that could include a single perforated belt or multiple belts entrained around a vacuum plenum. The prefuser vacuum transport plenum features a convex curvature profile. This feature allows for heavy weight sheets to be acquired even after their natural tendency to curve downward is manifested. Controlling curvature of the bottom surface of the vacuum plenum provides greater latitude for paper acquisition. Any vacuum or other field (i.e., electrostatic) acquisition of any substrate (paper, Mylar, etc.) along any portion of it (not just the lead edge) could benefit from profiling the surface which provides the field input. The profiling should be designed around the worst case conditions.

While the embodiment shown herein is preferred, it will be appreciated that it is merely one example, and that various alterations, modifications, variations or improvements thereon may be made by those skilled in the art from this teaching, which is intended to be encompassed by the following claims:

What is claimed is:

1. A copier/printer including a photoreceptor adapted to receive page images thereon, copy sheets for receiving page images from the photoreceptor with the copy sheets exiting the photoreceptor horizontally and having the lead edge portion of the copy sheets cantilevered as they exit the photoreceptor, a transfer apparatus for transferring the page images from the photoreceptor to the copy sheets and a fuser for fusing the page images on the copy sheets, comprising:

a prefuser vacuum transport apparatus positioned between the photoreceptor and fuser adapted to receive cantilevered copy sheets from the photoreceptor and transport them to the fuser with the copy sheets suspended underneath said prefuser vacuum transport apparatus, said prefuser vacuum transport apparatus including a vacuum plenum; at least one drive roll and at least one idler roll; at least one perforated belt entrained around said at least one drive roll, said at least one idler roll and said vacuum plenum; and wherein said vacuum plenum includes a port surface with said port surface having a smooth, continuous, non-pointed, curved, convex profile to ensure close contact of the copy sheets with said smooth, continuous, non-pointed, curved, convex profile of said vacuum plenum, said contoured profile being adapted to follow the profile of the stiffest copy sheets with the maximum specified curl.

2. The vacuum transport of claim 1, wherein said idler roll is an elongated shaft.

3. The vacuum transport of claim 1, wherein said at least one drive roll is an elongated shaft.

* * * * *